US012781747B2

(12) United States Patent
Huang et al.

(10) Patent No.: US 12,781,747 B2
(45) Date of Patent: Nov. 3, 2026

(54) WATER PUMP CONTROL DEVICE

(71) Applicant: Delta Electronics, Inc., Taoyuan City (TW)

(72) Inventors: Hsin Min Huang, Taoyuan City (TW); Chia Yang Yu, Taoyuan City (TW); Yu Cheng Lin, Taoyuan City (TW)

(73) Assignee: Delta Electronics, Inc., Taoyuan City (TW)

( * ) Notice: Subject to any disclaimer, the term of this patent is extended or adjusted under 35 U.S.C. 154(b) by 0 days.

(21) Appl. No.: 19/080,988

(22) Filed: Mar. 17, 2025

(65) Prior Publication Data

US 2026/0043407 A1 Feb. 12, 2026

(30) Foreign Application Priority Data

Aug. 8, 2024 (CN) ..... 202421918361.X

(51) Int. Cl.

| | |
|---|---|
| ***F04D 15/00*** | (2006.01) |
| ***F04D 13/06*** | (2006.01) |
| ***F04D 15/02*** | (2006.01) |
| ***F04D 25/06*** | (2006.01) |
| ***F04D 27/00*** | (2006.01) |
| ***F04D 27/02*** | (2006.01) |

(52) U.S. Cl.

CPC ..... *F04D 15/0066* (2013.01); *F04D 15/0218* (2013.01); *F04D 15/0281* (2013.01); *F04D 13/06* (2013.01); *F04D 15/0077* (2013.01); *F04D 15/0083* (2013.01); *F04D 15/0236* (2013.01); *F04D 25/0606* (2013.01); *F04D 27/008* (2013.01); *F04D 27/02* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,059,536 | A * | 5/2000 | Stingl | F04B 49/06 417/44.1 |
| 11,035,367 | B1 * | 6/2021 | Hansen | F04B 23/021 |
| 12,523,232 | B2 * | 1/2026 | Mayleben | F04D 27/001 |
| 2017/0089345 | A1 * | 3/2017 | Afshar | F04D 15/0236 |
| 2017/0254333 | A1 * | 9/2017 | Shuy | F04B 23/02 |
| 2018/0156211 | A1 * | 6/2018 | Bishop | F04B 49/08 |
| 2018/0178884 | A1 * | 6/2018 | Beardmore | B63B 13/00 |
| 2019/0249650 | A1 * | 8/2019 | Coney | F04C 15/008 |

* cited by examiner

*Primary Examiner* — Binh Q Tran

(57) ABSTRACT

A water pump control device is disclosed, in which a switching module powered by a system power supply receives information from a sensor and/or an emergency switch to generate a control signal to control a power switch to connect or disconnect a power supply path between a water pump and a water pump power supply according to the control signal. Therefore, in a cooling system, in the event of liquid leakage, abnormal water level, or an alarm signal issued by an emergency switch, the switching module can independently cut off the power source of the water pump via the power switch, such that the water pump can effectively stop running and avoid the scope of influence is expanded. At the same time, components other than the water pump can still be powered and operated as usual, avoiding other control abnormalities caused by power outages of the water pump.

18 Claims, 2 Drawing Sheets

WATER PUMP CONTROL DEVICE

CROSS REFERENCE TO RELATED APPLICATIONS

This application claims the benefit of priority of Chinese Patent Application No. 202421918361.X, filed on Aug. 8, 2024, the contents of which are incorporated by reference as if fully set forth herein in their entirety.

FIELD OF THE INVENTION

The present disclosure relates to an electronic control technology, in particular to a water pump control device powered by dual power supplies.

BACKGROUND OF THE INVENTION

In cooling systems, water pumps are essential in driving liquid flow, wherein a sensing control loop is a form of single-end output action. If a sensing control loop fails, causing the water pump not to stop running in time, then it will lead to severe abnormalities in the cooling system.

Given the above, it is necessary to provide a technical solution different from the previous ones to solve the problems existing in conventional technology.

SUMMARY OF THE INVENTION

The object of the present disclosure is to provide a water pump control device to avoid a failure from a control loop that causes the water pump not to stop running in time.

To achieve the above object, an aspect of the present disclosure is to provide a water pump control device, which includes a sensor, a switching module, a power switch, and a water pump. The switching module is electrically connected to the sensor mentioned above. The power switch is electrically connected to the switching module mentioned above. The water pump is electrically connected to the power switch mentioned above. The power switch is electrically connected between the water pump and the water pump power supply, and the switching module is electrically connected to the system power supply, wherein the water pump power supply is different from the system power supply. The switching module is configured to control the power switch according to information output by the sensor to enable the power switch to connect or disconnect a power supply path between the water pump and the water pump power supply.

To achieve the above purpose, another aspect of the present disclosure is to provide a water pump control device, which includes an emergency switch, a switching module, a power switch, and a water pump. The switching module is electrically connected to the emergency switch. The power switch is electrically connected to the switching module. The water pump is electrically connected to the power switch. The emergency switch, the switching module, and the system power supply are sequentially connected in series, and the power switch is electrically connected between the water pump and the water pump power supply. The switching module is configured to control the power switch according to information output by the emergency switch to enable the power switch to connect or disconnect a power supply path between the water pump and the water pump power supply.

In the water pump control devices of embodiments of the present disclosure, the switching module powered by the system power source receives information from the sensor and/or the emergency switch to generate a control signal, and the control signal is used to control the power switch, which connects or disconnects the power supply path between the water pump and its power source. Therefore, in a cooling system, in the event of liquid leakage, abnormal water level, or an emergency switch issuing an alarm signal, the switching module can independently cut off a power source supplied to the water pump via the power switch, causing the water pump to effectively stop running to avoid expanding the scope of the impact. Meanwhile, components other than the water pump can still be powered and operated as usual to prevent other control abnormalities resulting from a power outage of the water pump. In addition, the water pump control device can also be modularized to facilitate product storage, transportation, assembly, and maintenance, which is conducive to enhancing product competitiveness.

THE DETAILED DESCRIPTION OF PREFERRED EMBODIMENTS

In cooling systems (such as chilled water cooling systems), water pumps are essential in driving liquid flow, wherein a sensing control loop is a form of single-end output action. If the sensing control loop fails, causing the water pump to be unable to stop running in time, abnormalities in the cooling systems will occur, making failures on the cooling systems more severe and causing more significant cost losses.

Given the above, the present disclosure proposes a water pump control device with dual-end output action powered by two power supplies. For example, it can be applied to chilled water cooling systems, liquid cooling systems, air-assisted liquid cooling systems, or water pump systems. Herein, a chilled water cooling system is merely an example of a cooling system. Embodiments of the water pump control device are illustrated below but are not limited to the description here.

Figure 1:
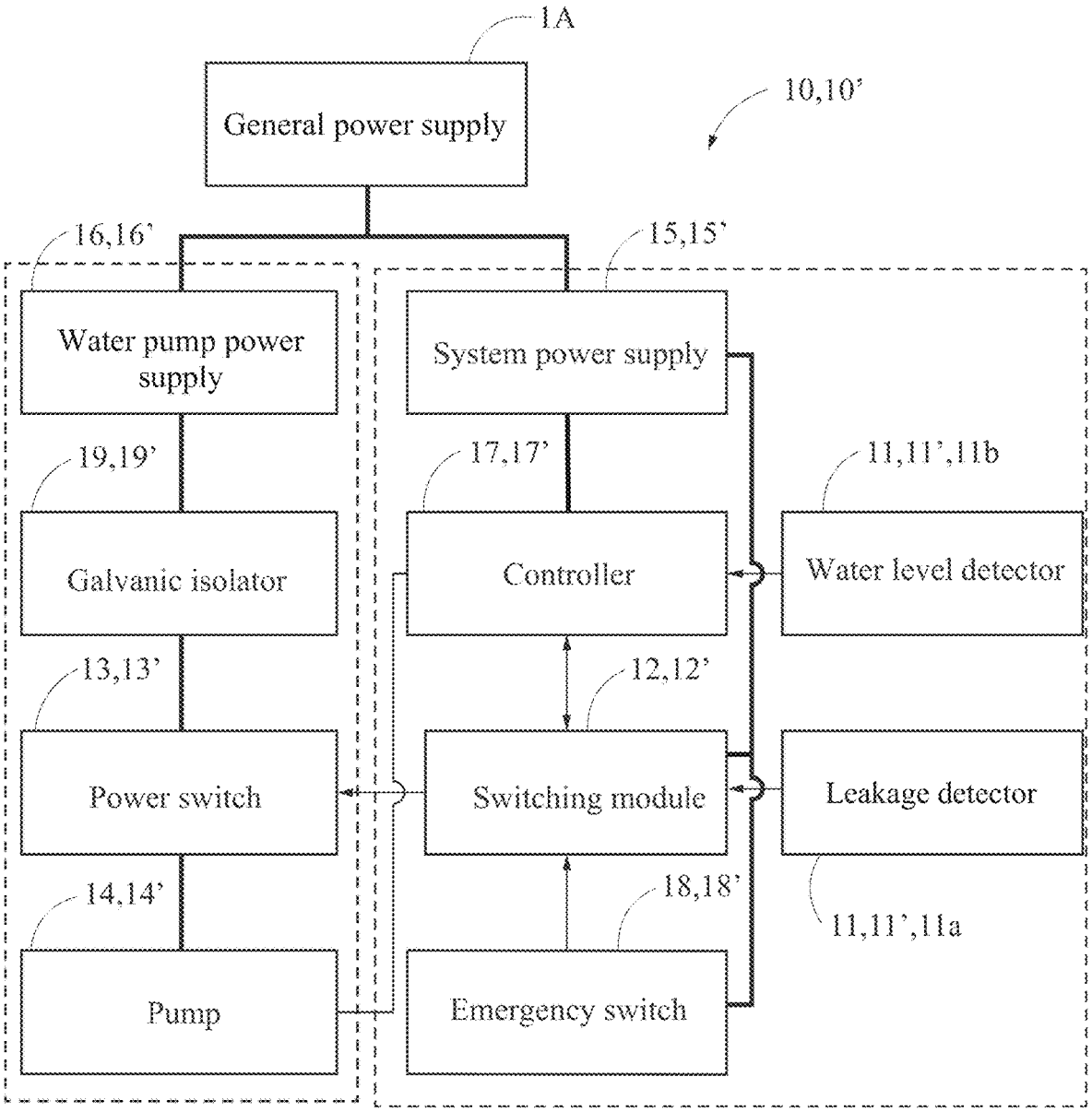
FIG. 1 is a block diagram illustrating a water pump control device provided in embodiments of the present disclosure.

For example, as shown in FIG. 1, a first embodiment of the present disclosure provides a water pump control device 10, including at least one sensor 11, a switching module 12, a power switch 13, and a water pump 14 to perform water pump control operations. For example, the power supply status of the water pump 14 is controlled according to the relevant information of the sensor 11 but is not limited to the description here. Examples are provided as follows.

In some embodiments, as shown in FIG. 1, for example, the sensor 11 can be a sensor capable of liquid leakage and water level detection, such as a water level detector, a leakage detector, or a detection control circuit that comprises a comparator and a control logic circuit electrically connected to the comparator. For example, the control logic circuit and the comparator of the detection control circuit are configured to be capable of or assist in processing signals related to the aforementioned detection, such as liquid leakage or water level detection signals output from the water level detector or the leakage detector. Still, it is not intended to be limited to the description above. For example, it can also be a sensor, such as a photoelectric sensor, to provide detection information for environmental substances (such as liquids) to assist in water pump control operations.

In some embodiments, as shown in FIG. 1, for example, at least one sensor 11 includes a leakage detector 11*a*, such as a liquid leakage detector. The leakage detector 11*a* is electrically connected to the switching module 12. The leakage detector 11*a* is electrically connected to the switching module 12. Leakage sensing signals from the leakage detector 11*a* can be directly used as an input signal source for the switching module 12, such that the switching module 12 can generate a control signal according to the input signal. In this way, in the cooling system, it can be detected whether there is a liquid leakage in the container or pipeline in an environment in time, so as to assist in determining whether the water pump needs to be stopped.

It should be noted that because the leakage sensing signal is a type of signal that needs urgent processing, once a leakage is discovered, it must be processed as soon as possible to avoid the expansion of system abnormalities. Therefore, transmitting the leakage sensing signal directly to the switching module avoids the requirement for the leakage sensing signal to be transmitted to the switching module via other electronic components (such as the controller). It can prevent other electronic components (such as a controller) from malfunctioning or abnormality, resulting in the leakage sensing signal being unable to transmit to the switching module to ensure that the switching module can generate a control signal based on the leakage sensing signal timely.

In some embodiments, as shown in FIG. 1, for example, the switching module 12 can be a circuit capable of selecting signals, e.g., one of a plurality of input signals is selected to be severed as an output signal. For example, the switching module 12 includes a comparator and a control logic circuit (such as a logic circuit including an "OR gate" and/or an "AND gate"). The comparator is electrically connected to the control logic circuit to use an input signal as an output signal or select one of a plurality of signals as an output signal according to a selection condition. For example, the switching module 12 is electrically connected to the power switch 13 and the at least one sensor 11 to control the power switch 13 according to information (such as a signal representing a sensing value or a sensing state) output by the at least one sensor 11.

In some embodiments, as shown in FIG. 1, for example, the power switch 13 is a DC power switch. For example, a DC contactor is a device that generates a magnetic field using a coil to facilitate the control of electrical equipment. Suitable devices can be selected as components capable of switching AC or DC circuits and are withstandable for larger currents, such as an electromagnetic contactor or a solid-state relay, but are not limited to the description here. The power switch 13 can also be configured as a circuit capable of selectively transmitting power to transmit DC power, such as the DC power that drives the water pump 14 to generate power.

In some embodiments, as shown in FIG. 1, for example, the water pump 14 can be any water pump assembled by a DC motor. The water pump 14 is electrically connected to the power switch 13. The power switch 13 can be controlled by the switching module 12 to turn on or turn off the power required for the operations of the water pump 14. For example, the DC power is continuously transmitted to the water pump 14 through the power switch 13. The water pump 14 is driven by the DC power transmitted by the power switch 13 and operates to pump the liquid, such as water, but is not limited to the description here, and can also be other liquids. For example, in a cooling system, the circulating liquid can be other coolants or refrigerants.

The following example illustrates a configuration of the water pump control device provided in the first embodiment of the present disclosure powered by dual power supplies. Still, it is not limited to the description here.

For example, as shown in FIG. 1, the switching module 12 is electrically connected to a system power supply 15. The system power supply 15 is configured to form a DC output terminal of a low-voltage DC supply, such as supplying DC 3.3 volts (V). Still, it is not limited to the description here. The power switch 13 is electrically connected between the water pump 14 and a water pump power supply 16. The water pump power supply 16 is configured to form a DC output terminal of a high-power DC supply, such as supplying DC 12 or 24 volts (V). Still, it is not limited to the description here. In this example, the system power supply 15 and the water pump power supply 16 are different. The power (e.g., the DC power) of the system power supply 15 and the water pump power supply 16 can be provided from a general power supply 1A (such as forming an uninterruptible power supply system (UPS) or a mains plug-in terminal). Still, it is not limited to the description here. The switching module 12 is configured to control the power switch 13 according to information output by at least one sensor 11. For example, the switching module 12 generates a control signal to enable the power switch 13 to connect or disconnect a power supply path between the water pump 14 and the water pump power supply 16.

As shown in FIG. 1, when there is a specific situation (such as an emergency power outage event for the water pump), the power switch 13 can be controlled to cut off the power supply path between the water pump 14 and the water pump power supply 16, such that the water pump 14 stops operating. At this moment, components other than the water pump 14 (such as the sensor 11 and the switching module 12) can also be powered by the system power supply 15 and continue to operate, such as continuously performing environmental parameter monitoring and communication operations, but are not limited to the description here.

In some embodiments, as shown in FIG. 1, the water pump control device 10 further includes a controller 17. The controller 17 is an electronic element with signal processing or control functions, such as a programmable logic controller (PLC) or a microprocessor (MCU). For example, the system power supply 15, the controller 17, and the switching module 12 are sequentially connected in series, e.g., the controller 17 is electrically connected to the system power supply 15 as the power source, the controller 17 is electrically connected to the switching module 12. The controller 17 is configured to communicate with the switching module 12. For example, the controller 17 transmits signals such as signals indicating sensed status to the switching module 12. The controller 17 can also receive operating status signals, such as signals indicating normal or abnormal operations, from the switching module 12 to assist the controller 17 in executing internal control logic and issuing warning messages based on signals indicating abnormal system status, such as specific forms of messages (such as generating acoustic, optical and/or electrical information), but are not limited to the description here. In this way, in the cooling system, the controller independent of the switching module can be configured to perform routine operations, such as continuously performing signal conversion or communication operations.

In some embodiments, as shown in FIG. 1, for example, at least one sensor 11 also includes a water level detector 11*b*, such as a liquid position detector. The controller 17 is electrically connected to the water level detector 11*b* and the switching module 12. The controller 17 receives water level sensing signals from the water level detector 11*b* and then converts the water level sensing signals into specific format signals, such as representing values of binary quantized codes, to generate water level status signals or water level alarm signals, to transmit the information from the detection meter 11*b* to the switching module 12 as an input signal source of the switching module 12, such that the switching module 12 generates a control signal according to input signals. In this way, in the cooling system, the environment can be detected in time whether the liquid level in the container or pipeline is too high, too low, or other conditions for alarming, to assist in determining whether the water pump needs to be stopped.

In the embodiments mentioned above, the sensor 11 can be arranged in such a way that the sensor 11, the controller 17, and the switching module 12 are sequentially connected in series. Alternatively, the sensor 11 can be directly connected to the switching module 12.

In some embodiments, as shown in FIG. 1, the controller 17 can also be electrically connected to the water pump 14. For example, the controller 17 is also configured to control a rotation speed of the water pump 14, such as controlling the rotation speed of the water pump 14 using pulse wave modulation (PWM) signals, but not limited to the description here. In this way, in the cooling system, the horizontal rotation speed can be controlled according to different cooling demand conditions to facilitate the control of the flow or circulation state of the coolant or refrigerant.

In some embodiments, as shown in FIG. 1, the water pump control device 10 also includes an emergency switch 18. For example, the emergency switch 18 can be a manual switch (such as a hardware push-button switch) or a remote-control switch (such as a software interface switch). Here, only an example of an emergency stop button suitable for public and industrial equipment is taken as the emergency switch 18 (but is not limited to the description here) to generate an emergency command (such as a power-off command for the water pump) based on a manual input action or a remote signal to stop the operation of the water pump 14 in response to emergencies (such as abnormal conditions being established). For example, the water pump 14 cannot stop the operation in time in response to abnormal situations such as liquid leakage or abnormal water levels. The emergency switch 18 can also be used to generate a water pump power-off command to stop operations of the water pump 14 as another abnormality protection mechanism.

For example, as shown in FIG. 1, the emergency switch 18 is electrically connected to the switching module 12. The emergency switch 18 is electrically connected to the system power supply 15 and the switching module 12. The switching module 12 may be configured to control the power switch 13 according to information output by at least one sensor 11 or the emergency switch 18. For example, the switching module 12 is configured to control the power switch 13 according to the information output by the emergency switch 18 (such as a water pump power-off command for disconnecting a power transmission path of the water pump), causing the water pump 14 to connect or disconnect to the water pump power supply 16 to make the water pump 14 in a power-on or power-off state. The information output by the emergency switch 18 can also be used as a status signal indicating abnormal system operation. In this way, in the event of an emergency stop of the water pump, for example, if the water pump cannot stop operating in time in response to abnormal situations such as liquid leakage or abnormal water level, it can ensure that the water pump can be powered off and stopped to avoid expanding the scope of the abnormal impact and also improve the system security of water pump applications.

For example, as shown in FIG. 1, when the normal or abnormal conditions of the cooling system are not established, for example, if the cooling system needs to be shut down preventively in response to an expected power outage, the emergency switch 18 can also be manually prompted by personnel to issue an emergency command to stop the operation of the water pump. It should be understood that, regardless of whether the cooling system is normal or abnormal, the emergency command issued by the emergency switch 18 has the highest priority, that is, when the switching module 12 receives the emergency command issued by the emergency switch 18, the switching module 12 will immediately generate the control signal to drive the power switch 13 to disconnect the power supply path between the water pump 14 and the water pump power supply 16. At the same time, components other than the water pump 14 can continue to operate, such as generating or transmitting information.

For example, as shown in FIG. 1, after the abnormal situation is eliminated, in cases such as the water level is normal, leakage is eliminated, and the emergency switch is manually reset, the switching module 12 can also output a control signal to control the power switch 13 to reconnect the power supply path between the water pump power supply 16 and the water pump 14, enabling the water pump 14 to be powered back on and restarted.

In some embodiments, as shown in FIG. 1, the water pump control device 10 further includes a galvanic isolator 19. For example, the galvanic isolator 19 is a hot-pluggable module. For example, the hot-pluggable module can be configured to have surge current isolation and communication capabilities. The hot-pluggable module can be a general-purpose hot-pluggable hardware circuit, including integrated functions such as voltage detectors, current detectors, power detectors, and communicators. The water pump power supply 16, the current isolator 19, the power switch 13, and the water pump 14 are sequentially connected in series. For example, the current isolator 19 is electrically connected to the water pump power supply 16, which serves as a power supply source; the current isolator 19 is electrically connected to the power switch 13 to isolate the surge current generated at the moment when the water pump 14 is shut down and restarted after the power is restored to prevent the surge current from being transmitted to electronic components outside the water pump control device 10 and prevent the operation status of the electronic components outside the water pump control device 10 from being affected by the surge current and causing malfunctions.

In this way, when the water pump is stopped and restarted in response to an emergency, the system can avoid adverse effects caused by the emergency. In addition to reducing the repair costs after the emergency, it can also improve the robustness of the system operation, regardless of whether the water pump is in power on or off state, which does not affect the operation of parts of the system other than the water pump. For example, the system can still perform communication and environmental monitoring to facilitate related operations by outside personnel or remote systems.

Examples of the water pump control device provided by the first embodiment of the present disclosure use two power sources for supplying electric power. A DC output terminal of a high-power DC supply with a larger current is used to supply power to the water pump and electronic components (such as the power switch and the galvanic isolator) connected to the water pump in series, while a DC output terminal of a low-voltage DC supply with a lower voltage to supply power to related components used for control functions (such as the switching module, the controller, and the emergency switch). Therefore, the power source for supplying power to the relevant components used for control functions is independent of the water pump and its serially connected electronic components. In response to the emergency stop of the water pump, such as liquid leakage or abnormal water level, the sensing signals from the sensor are directly or indirectly transmitted to the water pump to serve as input signals so that the switching module generates a control signal based on the input signal to cut off the power source of the water pump, which can avoid expanding the scope of abnormal influence. At the same time, components other than the water pump can still be powered and operated as usual. For example, the controller can still perform operations such as data processing, communication, transmitting sensing information, conveying system status, and issuing alarm information to avoid other control abnormalities caused by the power outage of the water pump.

In examples of the water pump control device provided by the first embodiment of the present disclosure, the control signal used for the power source to supply power to the water pump are independently generated by adopting the switching module. It can avoid failure or abnormality of the controller causing the inability to generate signals to control the power source to supply power to the water pump, improving the robustness of the control process of the power source to supply power to the water pump, improving the system safety of water pump applications, increasing the adaptability and tolerance to emergencies, especially in promptly cutting off power to the water pump in response to emergency stop situations (such as liquid leakage or abnormal water levels), such that the water pump can effectively stop running.

It should be noted that in the present embodiment, regardless of whether the water pump is powered on or off, parts of the cooling system other than the water pump can still operate as usual (such as mutual communication) to facilitate real-time monitoring by personnel.

In addition, the water pump control device can be configured in other types to respond to the water pump control requirements of different application scenarios. Examples are provided below but are not limited to the description here.

For example, as shown in FIG. 1, a second embodiment of the present disclosure provides a water pump control device 10'. In the second embodiment, the water pump control device 10' includes an emergency switch 18', a switching module 12', a power switch 13', and a water pump 14' to perform water pump control operations. For example, the power supply status of the water pump 14' is controlled according to the relevant information of the emergency switch 18' but is not limited to the description here. Examples are as follows.

In the second embodiment, as shown in FIG. 1, the switching module 12' is electrically connected to the emergency switch 18' and the power switch 13'. The power switch 13' is electrically connected to the water pump 14'. The rest of the implementation of the emergency switch 18', switching module 12', power switch 13', and water pump 14' of the second embodiment can also refer to the relevant content of the emergency switch 18, the switching module 12, the power switch 13, and the water pump 14 of the first embodiment and will not be repeated here. But they are not limited, for example, in the second embodiment, the switching module 12' is a water level detector capable of providing water level detection signals for controlling the power switch 13', a leakage detector capable of providing leakage detection signals for controlling the power switch 13', or a detection control circuit that comprises a comparator and a control logic circuit electrically connected to the comparator, e.g., the control logic circuit and the comparator of the detection control circuit are configured to be capable of or assist in processing signals related to the aforementioned detector, such as the water level detector or the leakage detector, for controlling the power switch 13'.

In the second embodiment, as shown in FIG. 1, the emergency switch 18', the switching module 12', and a system power supply 15' are sequentially connected in series. The power switch 13' is electrically connected between the water pump 14' and a water pump power supply 16'. The switching module 12' is configured to control the power switch 13' according to information output by the emergency switch 18' to enable the power switch 13' to connect or disconnect a power supply path between the water pump 14' and the water pump power supply 16'. Other implementations of the system power supply 15' and the water pump power supply 16' of the second embodiment can also refer to the relevant contents of the system power supply 15 and the water pump power supply 16 of the first embodiment and will not be repeated here.

In the second embodiment, as shown in FIG. 1, the water pump control device 10' may also include a controller 17' and a galvanic isolator 19'. For example, the system power supply 15', the controller 17', the switching module 12', and the emergency switch 18' are sequentially connected in series. The controller 17' is electrically connected to the switching module 12' and the water pump 14'. The water pump power supply 16', the galvanic isolator 19', the power switch 13', and the water pump 14' are sequentially connected in series. The galvanic isolator 19' is electrically connected to the power switch 13'. Other implementations of the controller 17' and the galvanic isolator 19' of the second embodiment can also refer to the relevant content of the controller 17 and the galvanic isolator 19 of the first embodiment and will not be repeated here.

Examples of the water pump control device provided by the second embodiment of the present disclosure use two power sources for supplying electric power. A DC output terminal of a high-power DC supply with a larger current is used to supply power to the water pump and electronic components (such as the power switch and the galvanic isolator) connected to the water pump in series, while a DC output terminal of a low-voltage DC supply with a lower voltage to supply power to related components used for control functions (such as the switching module, the controller, and the emergency switch). Therefore, the power source for supplying power to the relevant components used for control functions is independent of the water pump and electronic components connected to the water pump in series. In response to the emergency stop of the water pump, such as a person or machine issuing an emergency command (such as a water pump power-off command) via the emergency switch, signals derived from the emergency command from the emergency switch are used to be transmitted to the switching module as input signals so that the switching module generates a control signal based on the input signals to cut off the power source of the water pump. The switching module that generates the control signal based on the input signals to cut off the power source supplied to the water pump can avoid expanding the scope of abnormal influence. At the same time, components other than the water pump can still be powered and operated as usual to avoid other control abnormalities caused by the power outage of the water pump.

In examples of the water pump control device provided by the second embodiment of the present disclosure, the control signal used for the power source to supply power to the water pump are independently generated by adopting the switching module. It can avoid failure or abnormality of the controller causing the inability to generate signals to control the power source to supply power to the water pump, improving the robustness of the control process of the power source to supply power to the water pump, improving the system safety of water pump applications, increasing the adaptability and tolerance to emergencies, especially in promptly cutting off power to the water pump in response to emergency stop situations (such as the emergency command issued by the emergency switch), such that the water pump can effectively stop running.

It should be noted that in the present embodiment, regardless of whether the water pump is powered on or off, parts of the cooling system other than the water pump can still operate as usual (such as mutual communication) to facilitate real-time monitoring by personnel.

Figure 2:
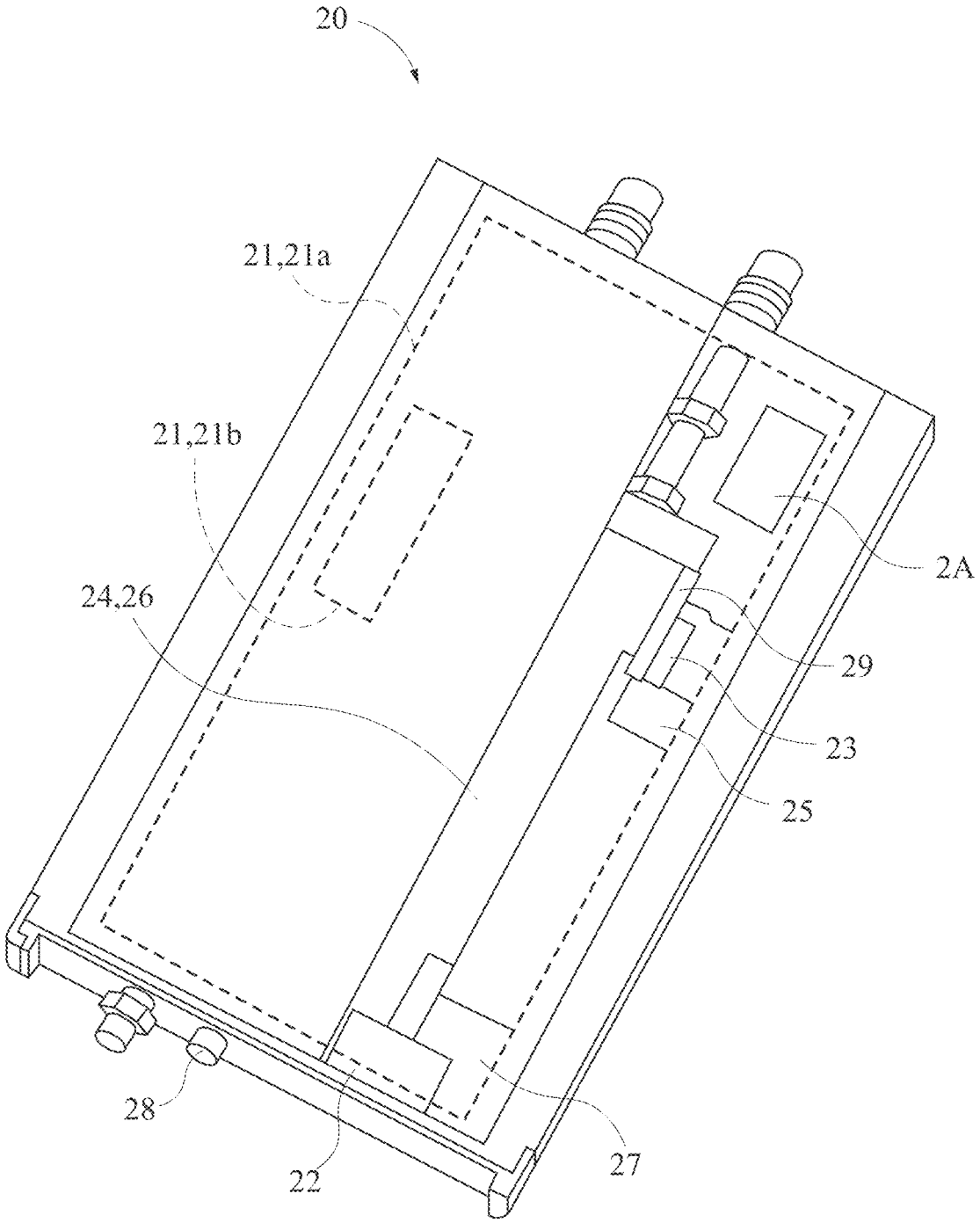
FIG. 2 is a schematic diagram illustrating a sample of a water pump control device provided in embodiments of the present disclosure.

Specifically, an implementation of the water pump control device mentioned as the above configuration is exemplified. As shown in FIG. 2, a plurality of configuration components of sample 20 of a water pump control device include a plurality of sensors 21, a switching module 22, a power switch 23, a water pump 24, a system power supply 25, a water pump power supply 26, a controller 27, an emergency switch 28, a galvanic isolator 29, and a general power supply 2A (such as an uninterruptible power supply system, UPS). The plurality of sensors 21, such as a leakage detector 21*a* configured at the bottom of a water tank and a water level detector 21*b* mounted in a water tank, the switching module 22, the power switch 23, the water pump 24, the system power supply 25, the water pump power supply 26, the controller 27, the emergency switch 28, the galvanic isolator 29, and the general power supply 2A can be appropriately installed in a circuit board according to actual needs to form a hardware module. In this example, the first embodiment is merely used as an example, but it is not limited to the description here. The relevant description can also be applied to the second embodiment. For example, an implementation of the sensors 21, the switching module 22, the power switch 23, the water pump 24, the system power supply 25, the water pump power supply 26, the controller 27, the emergency switch 28, the galvanic isolator 29, and general power supply 2A are the same as or similar to the sensor 11, the switching module 12, the power switch 13, the water pump 14, the system power supply 15, the water pump power supply 16, the controller 17, the emergency switch 18, the current isolator 19, and the general power supply 1A. In this way, many configurated components of the water pump control device can be integrated into a single modular product to facilitate product storage, transportation, assembly, and maintenance operations.

Although the present disclosure has been disclosed in preferred embodiments, any person ordinarily skilled in the art can make various changes and modifications without departing from the spirit and scope of the present disclosure. Therefore, the protection scope of the present disclosure shall be determined by the appended claims.

What is claimed is:

1. A water pump control device, comprising:

a sensor;

a switching module electrically connected to the sensor;

a power switch electrically connected to the switching module;

a water pump electrically connected to the power switch; and a galvanic isolator;

wherein the power switch is electrically connected between the water pump and a water pump power supply, the switching module is electrically connected to a system power supply that is different from the water pump power supply, and the switching module is configured to control the power switch based on information output by the sensor to enable the power switch to connect or disconnect a power supply path between the water pump and the water pump power supply;

wherein the water pump power supply, the galvanic isolator, the power switch, and the water pump are connected in series in sequence, and the galvanic isolator is a hot-pluggable module.

2. The water pump control device as claimed in claim 1, further comprising an emergency switch that is connected to the switching module, wherein the switching module is configured to control the power switch based on the information output by either the sensor or the emergency switch to cause the water pump to be connected to or disconnected from the water pump power supply.

3. The water pump control device as claimed in claim 2, wherein the emergency switch is a manual switch or a remote-control switch.

4. The water pump control device as claimed in claim 2, wherein the switching module is configured to control the power switch in priority based on the information output by the emergency switch to cause the water pump to be connected to or disconnected from the water pump power supply.

5. The water pump control device as claimed in claim 1, wherein the sensor is a water level detector, a leakage detector, or a detection control circuit that comprises a comparator and a control logic circuit electrically connected to the comparator.

6. The water pump control device as claimed in claim 1, wherein the power switch is a DC power switch.

7. The water pump control device as claimed in claim 6, wherein the DC power switch is an electromagnetic contactor or a solid-state relay.

8. The water pump control device as claimed in claim 1, wherein the hot-pluggable module is configured with a surge current isolation functionality.

9. The water pump control device as claimed in claim 1, further comprising a controller, wherein the system power supply, the controller, and the switching module are sequentially connected in series.

10. The water pump control device as claimed in claim 9, wherein the sensor, the controller, and the switching module are sequentially connected in series.

11. The water pump control device as claimed in claim 9, wherein the controller is a programmable logic controller (PLC) or a microprocessor (MCU).

12. The water pump control device as claimed in claim 1, wherein the sensor is directly connected to the switching module.

13. The water pump control device as claimed in claim 1, wherein the system power supply is a DC output terminal of a low-voltage DC power supply, and the water pump power supply is a DC output terminal of a high-power DC power supply.

14. A water pump control device, comprising:

an emergency switch;

a switching module electrically connected to the emergency switch;

a power switch electrically connected to the switching module;

a water pump electrically connected to the power switch; and a galvanic isolator;

wherein the emergency switch, the switching module, and a system power supply are sequentially connected in series, the power switch is electrically connected between the water pump and a water pump power supply, and the switching module is configured to control the power switch based on information output by the emergency switch to enable the power switch to connect or disconnect a power supply path between the water pump and the water pump power supply;

wherein the water pump power supply, the galvanic isolator, the power switch, and the water pump are connected in series in sequence, and the galvanic isolator is a hot-pluggable module.

15. The water pump control device as claimed in claim 14, wherein the switching module is a water level detector, a leakage detector, or a detection control circuit that comprises a comparator and a control logic circuit electrically connected to the comparator.

16. The water pump control device as claimed in claim 14, wherein the hot-pluggable module is configured with a surge current isolation functionality.

17. The water pump control device as claimed in claim 14, further comprising a controller, wherein the controller, the switching module, and the emergency switch are sequentially connected in series.

18. The water pump control device as claimed in claim 14, wherein the system power supply is a DC output terminal of a low-voltage DC power supply, and the water pump power supply is a DC output terminal of a high-power DC power supply.

* * * * *